United States Patent [19]

Laurich-Trost

[11] 4,363,409

[45] Dec. 14, 1982

[54] MULTI-PURPOSE UTILITY VEHICLE

[76] Inventor: Victor R. Laurich-Trost, 34600 McAfee Dr., Solon, Ohio 44139

[21] Appl. No.: 106,468

[22] Filed: Dec. 26, 1979

[51] Int. Cl.[3] ..... B66C 23/00; B65S 9/00

[52] U.S. Cl. ..... 212/184; 280/766; 212/189; 414/547

[58] Field of Search ..... 212/189, 187, 267, 268, 212/238, 188; 414/718, 496, 607, 543, 547, 912, 184; 280/763, 766, 765; 254/45, 86 H

[56] References Cited

U.S. PATENT DOCUMENTS

| | | | |
|---|---|---|---|
| 2,506,242 | 5/1950 | Shoemaker | 414/696 |
| 3,229,830 | 1/1966 | Smith | 414/547 X |
| 3,732,988 | 5/1973 | Lamev | 212/184 |
| 3,918,742 | 11/1975 | Gaibler et al. | 414/543 X |
| 3,990,714 | 11/1976 | Hornagold | 212/189 X |
| 4,084,777 | 4/1978 | Lambert | 212/189 X |

FOREIGN PATENT DOCUMENTS

| | | | |
|---|---|---|---|
| 931639 | 7/1955 | Fed. Rep. of Germany | 414/496 |
| 2535948 | 7/1976 | Fed. Rep. of Germany | 212/188 |
| 1548863 | 12/1967 | France | 414/547 |
| 1318199 | 5/1973 | United Kingdom | 414/543 |
| 187442 | 11/1966 | U.S.S.R. | 212/238 |

*Primary Examiner*—Andres Kashnikow
*Assistant Examiner*—L. Williams
*Attorney, Agent, or Firm*—Watts, Hoffmann, Fisher & Heinke Co.

[57] ABSTRACT

A multi-purpose utility vehicle which includes a self-propelled mobile, articulated vehicle having a cab on the chassis providing an enclosed and protected areas for an operator with a telescoping boom assembly pivotally mounted on the chassis for continuous movement through an arc of 360°. The vehicle mounts a lift platform mechanism disposed forwardly of the telescopic boom assembly. The vehicle includes a telescoping, generally pantograph outrigger assembly to provide a lateral support to the rear and/or front end of the vehicle. In addition, the present invention contemplates a novel steering system which comprises multi-steering functions including automatic front wheel steering only; automatic rear wheel steering only, automatic front and rear wheel steering; and front and rear wheel steering for turning through 90° in the same direction.

9 Claims, 11 Drawing Figures

MULTI-PURPOSE UTILITY VEHICLE

BACKGROUND OF THE INVENTION

The present invention relates to vehicles for material handling and more specifically relates to a new and novel design for a multi-purpose utility vehicle with telescopic boom and hydraulic platform lift functions in conjunction with a novel pantograph-type support structure for imparting stability to the vehicle during normal usage together with a multi-operational steering mode for a variety of industrial load-receiving operations. The subject of this application is related to the co-pending U.S. application of Victor Laurich-Trost filed Jul. 27, 1979 under Ser. No. 076-039,698.

Heretofore, it has been known to employ vehicles for handling various items and/or materials which include a telescopic boom or which employ a conventinal type lift platform (i.e. fork-lift) to provide various load-receiving functions. Such devices are illustrated, for example, in U.S. Pat. Nos. 1,598,220, 2,492,608, 2,820,561, 3,229,830, 3,337,231, 3,357,572 and 3,601,169.

It is an object of the present invention to provide a multi-purpose utility vehicle which provides, on one chasis, and articulated vehicle which incorporates a pivotally mounted telescopic boom assembly for continuous pivotal movement capable of rotation through an arc of 360°. The vehicle chassis also mounts a hydraulically operated lift platform assembly disposed at the forward end of the vehicle to provide a load-receiving function in response, for example, to loading from the telescopic boom assembly. Conversely, the lift-platform may function to provide a load service for the telescopic boom assembly. Accordingly, the telescopic boom assembly has a continuous rotational movement about a horizontal axis of 360° and may provide a service for loading the lift platform assembly and vice versa, as desired.

SUMMARY OF THE INVENTION

A multi-purpose utility vehicle which incorporates a telescopic boom assembly for continuous pivotal or slewing movement through an arc of 360°. The boom is pivotally mounted for rotational movement about a vertical axis for use in loading and unloading various types of objects or materials via conventional types grapples, tongs, clamshell buckets or the like. In the invention, the pivoting or slewing of the telescoping boom is provided by a generally vertically disposed post and ring gear operated by a suitable hydraulic motor. The vehicle mounts a lift-platform disposed forwardly of the vehicle chassis to service and/or to be serviced by the telescopic boom assembly. The telescopic boom and lift platform arrangements are mounted on the vehicle for maximum operating efficiency via a series of hydraulically actuated jacks which act to distribute the load forces generally uniformally across the transverse area of the vehicle chassis to impart maximum stability during normal usage thereof. In the invention, either the front and/or rear of the vehicle chassis may be provided with a novel pantograph-type outrigger support structure which may mount all and/or certain of the hydraulic jacks for longitudinal and/or lateral telescopic movement so as to provide a stabilization system which can be selectively controlled in relation to the load to be handled by the telescopic boom and lift platform assembly. Accordingly, by this arrangement the telescopic boom may be pivoted or slewed through an arc of 360° about a vertical axis under conditions of optimum stability for handling loads under a wide range of commercial and industrial applications.

More specifically, in the present invention the telescoping boom may be pivoted or slewed through an arc of 360° about a vertical axis and pivoted upwardly through a plane at right angles to the general horizonal plane of the chassis and disposed through an angle of approximately 75°. Preferably, the boom has two telescopic outer sections which enable the boom to have an operating length of approximately 25 feet when disposed in the horizontal position and approximately 35 feet when disposed at 75°. When disposed in the horizontal position and extended to approximately 25 feet, the boom has lifting capacity in excess of 9,000 pounds and when disposed at the full 31 feet about 7,000 pounds. More specifically, the boom has a capacity (at horizontal distance from the axis of rotation) of 26,896 pounds at 8.5 feet; 17,636 pounds at 13.5 feet; 12,786 pounds at 19 feet; 9,920 pounds at 25 feet; and 7,000 pounds (optional) at 31 feet. A man bracket, scrap grapple, clamshell bracket, pneumatic hammer, backhoe, magnet or other service attachments can be quickly mounted to the end of the boom for various applications, as desired.

In the invention, the vehicle incorporates a novel steering system which includes five modes of operation. These operational modes include a neutral position (all wheels in a straight position); front wheels steer only (automotive); rear wheels steer only (automotive); front and rear wheels steer (front and rear in opposite directions); and front and rear wheels steer for a 90° turn (same direction).

DESCRIPTION OF THE PREFERRED EMBODIMENTS

Figure 1:
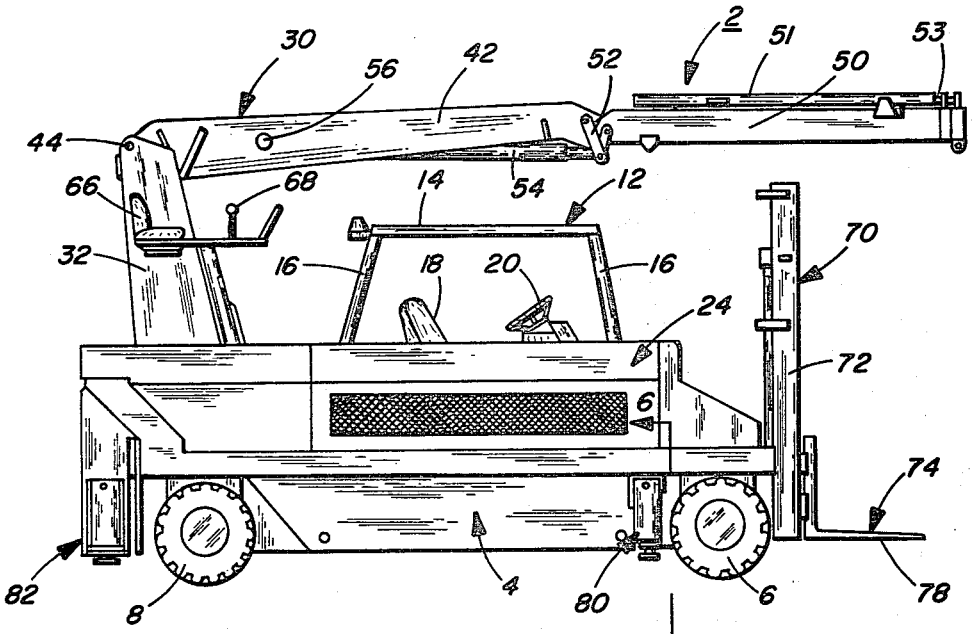
FIG. 1 is a side elevation of the multi-purpose utility vehicle in accordance with the present invention.

Referring now again to the drawings and in particular to FIGS. 1 through 4 thereof, there is illustrated the multi-purpose utility vehicle of the invention, designated generally at 2, which includes a chassis 4. The chassis is mounted for forward, rearward and pivotal turning movement via a pair of front wheels 6 and a pair of rear wheels 8. The chassis includes a work-platform 10 (FIG. 3) which extends substantially throughout the length of the chassis and provides a support for a framework 12 which functions to provide a protective area surrounding the operator for the vehicle. The framework 12 is of a rigid assembly comprised of a roof 14 and a plurality (four) of inclined posts 16 rigidly connected to the floor or support surface 10 of the chassis. This framework provides a convenient operators station which gives good visibility for the operator when positioned in the seat 18, and which includes a suitable steering wheel 20 and controls for the vehicle.

Figure 2:
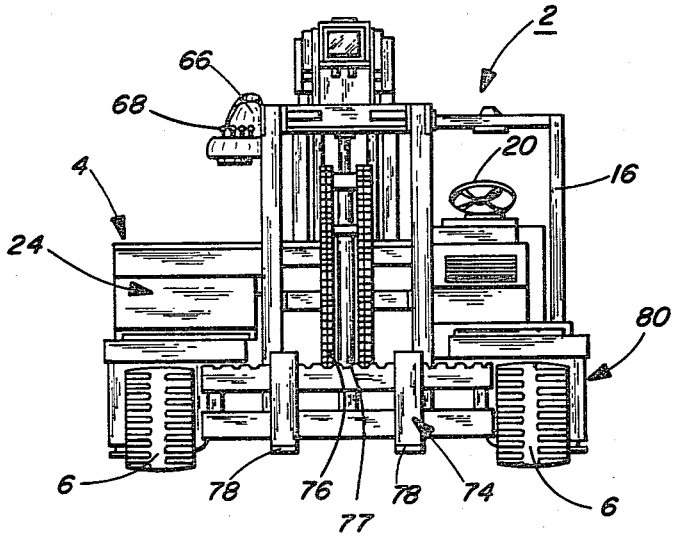
FIG. 2 is a front elevation view looking from the right-hand side of FIG. 1.
Figure 3:
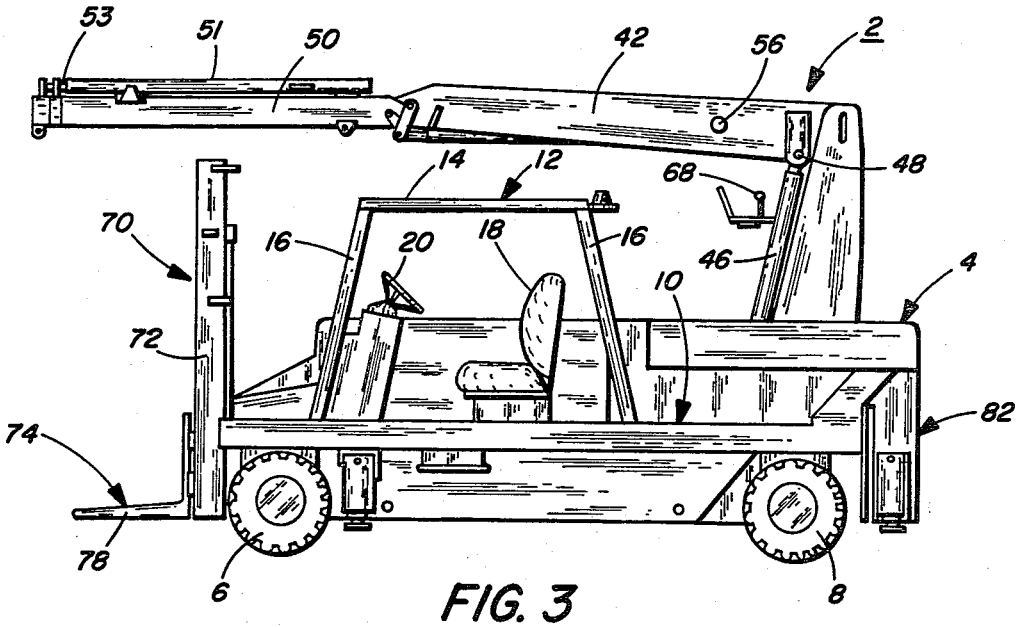
FIG. 3 is a side elevation view looking from the side opposite to that of FIG. 1.
Figure 4:
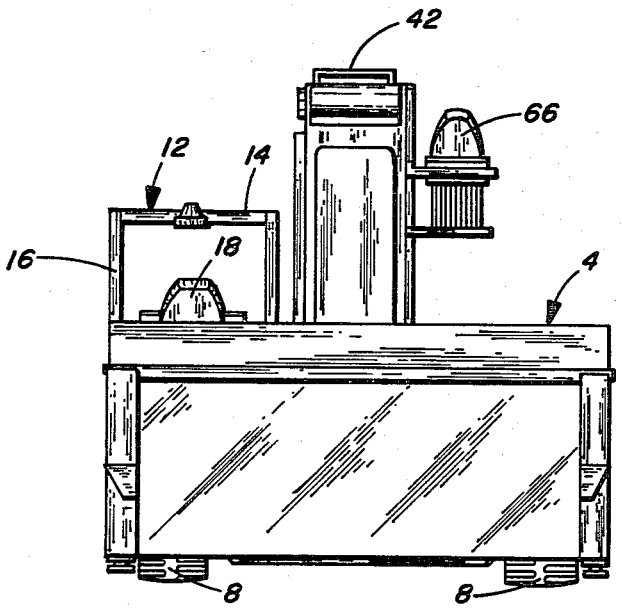
FIG. 4 is a rear elevation view looking from the right-hand side of FIG. 3.

In the invention, it is preferred that the framework 12 defining the operators station be disposed laterally in off-set relation (FIG. 4) in respect to the longitudinal central axis of the vehicle chassis. By this arrangement, ready access is given to the operator from one side of the vehicle which also enables the boom assembly and operator therefore to be disposed on the other side of the vehicle for maximum operating efficiency and visibility. Accordingly, the motor drive unit for the vehicle, designated generally at 24, including that for the boom and lift platform assemblies is disposed on the opposite side of the vehicle chassis, as best seen in FIGS. 1, 2 and 3.

Figure 9:
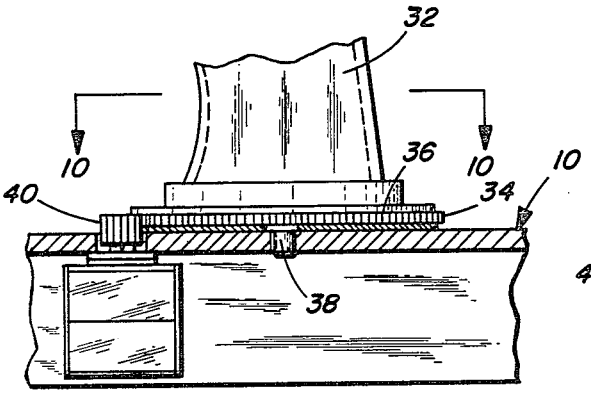
FIG. 9 is a fragmentary horizontal section view, on an enlarged scale.
Figure 10:
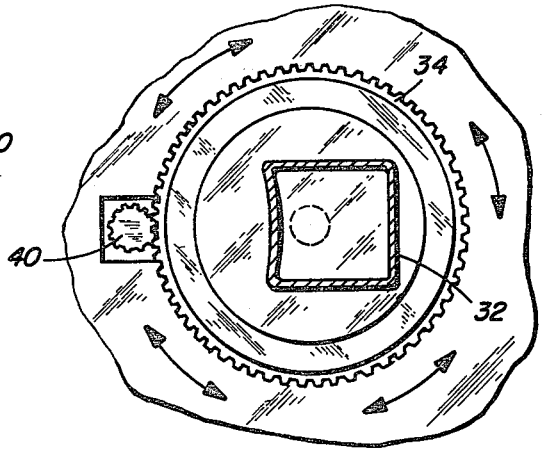
FIG. 10 is a fragmentary horizontal view taken along the line 10—10 of FIG. 9.

Now in the invention, the vehicle mounts a boom assembly, designated generally at 30, which is pivotally mounted for continuous movement through an arc of 360° on the vehicle chassis 4. As shown, the assembly 30 includes an upstanding base member 32 which is pivotally mounted on the floor 10 (FIG. 9) of the chassis by means of a ring gear 34 which may be secured to a base plate 36 such that the base member 32 may pivot about a pivot pin 38 disposed in the floor of the chassis. The ring gear 34 may be driven by a drive gear 40 which may be selectively driven by the motor 24 for rotation for slewing about a vertical axis.

Figure 5:
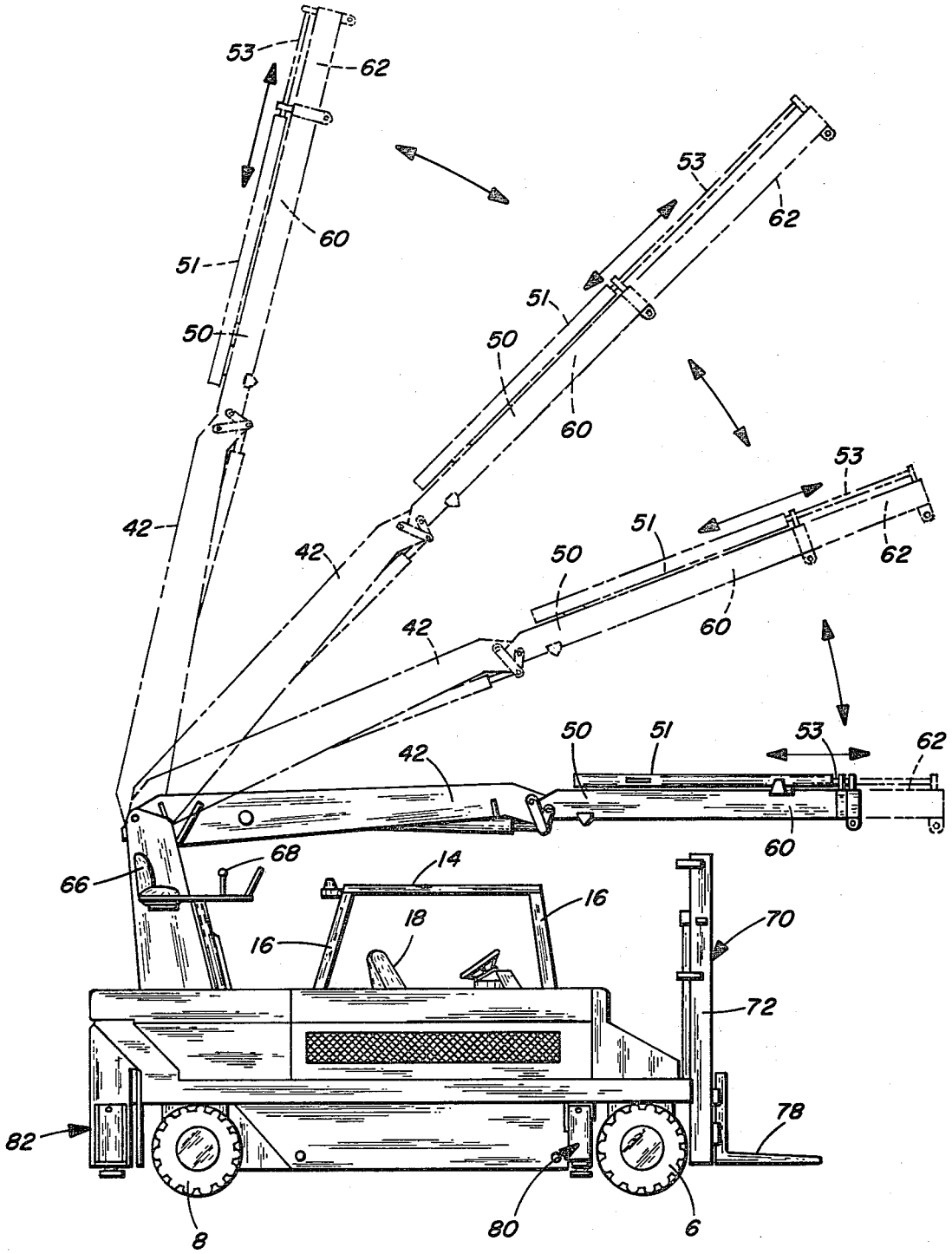
FIG. 5 is a side elevation view illustrating, in phantom lines, the telescopic and pivotal movement of the boom assembly through 75°.

The base member 32 pivotally mounts a inner mast section 42 via a pivot pin 44. Pivotal movement of the member 42 about the pivot pin 44 is accomplished by a hydraulic cylinder 46 (FIG. 3) connected at one end to the chassis and pivotally connected at the other end, as at 48, to the member 42. An outer mast section 50 is pivotally mounted via a linkage, as at 52, to the inner mast section 42 and is pivotally actuated by another hydraulic cylinder 54 which may be pivotally connected, as at 56, to the inner mast section to allow pivotal movement of the outer mast section 50 via the pivotal linkage 52. As best seen in FIG. 5, the outer mast section 50 mounts an outer pair of telescopic sections 60 and 62 with the outer section 62 being telescopically received in the inner section 60 for axial telescopic movement as illustrated by the arrows in FIG. 5. The inner and outer section 60 and 62 are actuated by another hydraulic cylinder 51 and piston 53 so that the boom can be selectively varied in length for the desired load carrying application. The hydraulic boom assembly may be provided with an operators seat 66 having suitable controls 68 for actuating the boom assembly.

In the invention, the boom assembly may include the various optional accessory systems such as winch, remote controls, scrape grapple, timber tongs, clamshell bucket, forks with a rotator, forks and clamps for pipe and poles, magnetics or the like.

As best illustrated in FIGS. 1 and 2, the vehicle mounts at the forward end a lift-platform assembly, designated generally at 70, which is disposed generally centrally of the vehicle chassis. As shown, the assembly 70 includes a framework 72 rigidly connected to the vehicle chassis. The assembly 70 mounts a lift-platform 74 which may be actuated by a chain-drive 76 for raising and lowering the platform 74 which may comprise a pair of fork-arms 78. The chain-drive 76 may be operably connected to a hydraulic cylinder 77 for raising and lowering, in a manner known in the art. By this arrangement, the chassis of the vehicle is supported upon the wheels 6 and 8 with the boom assembly 30 disposed rearwardly of the chassis and the lift-platform assembly 70 disposed forwardly on the chassis so as to provide an effective counter-balancing of the weight carried on the chassis.

Now in the invention, a pantograph-type, outrigger support assembly is provided for stabilizing the vehicle during usage of the boom and/or lift-platform assemblies. As shown, this assembly includes a front outrigger mechanism 80 and a rear outrigger mechanism 82 fixedly connected to the vehicle chassis. In the embodiment illustrated, the front mechanism 80 is preferably disposed for extensible movement transversely of the vehicle chassis while the rear mechanism 82 is disposed for such transverse extensive movement and also longitudinal extensible movement rearwardly in a direction away from the vehicle chassis. It will be understood, however, that the vehicle can be modified for certain applications wherein the rear mechanism may be employed at the front of the vehicle and vice versa, as desired.

Figure 6:
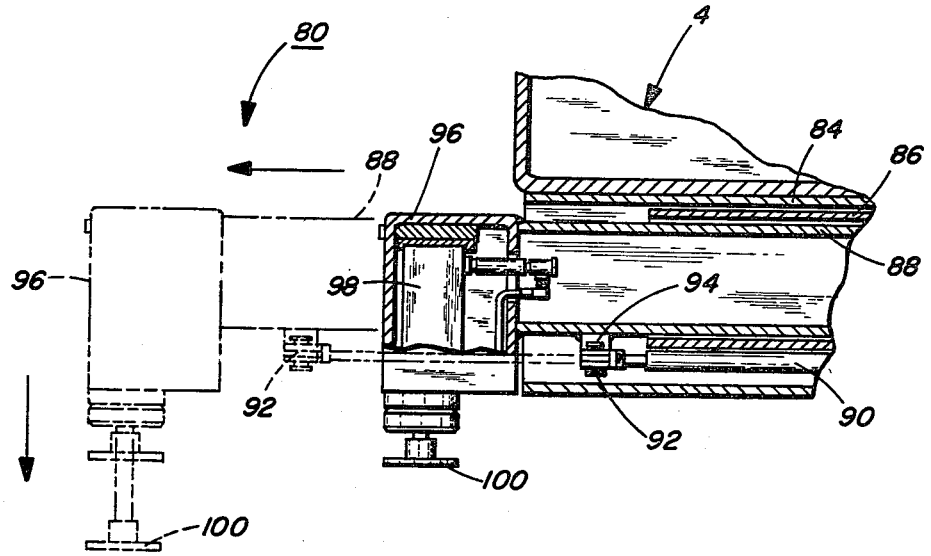
FIG. 6 is a fragmentary, vertical section view taken along the line 6—6 of FIG. 1 on an enlarged scale.
Figure 11:
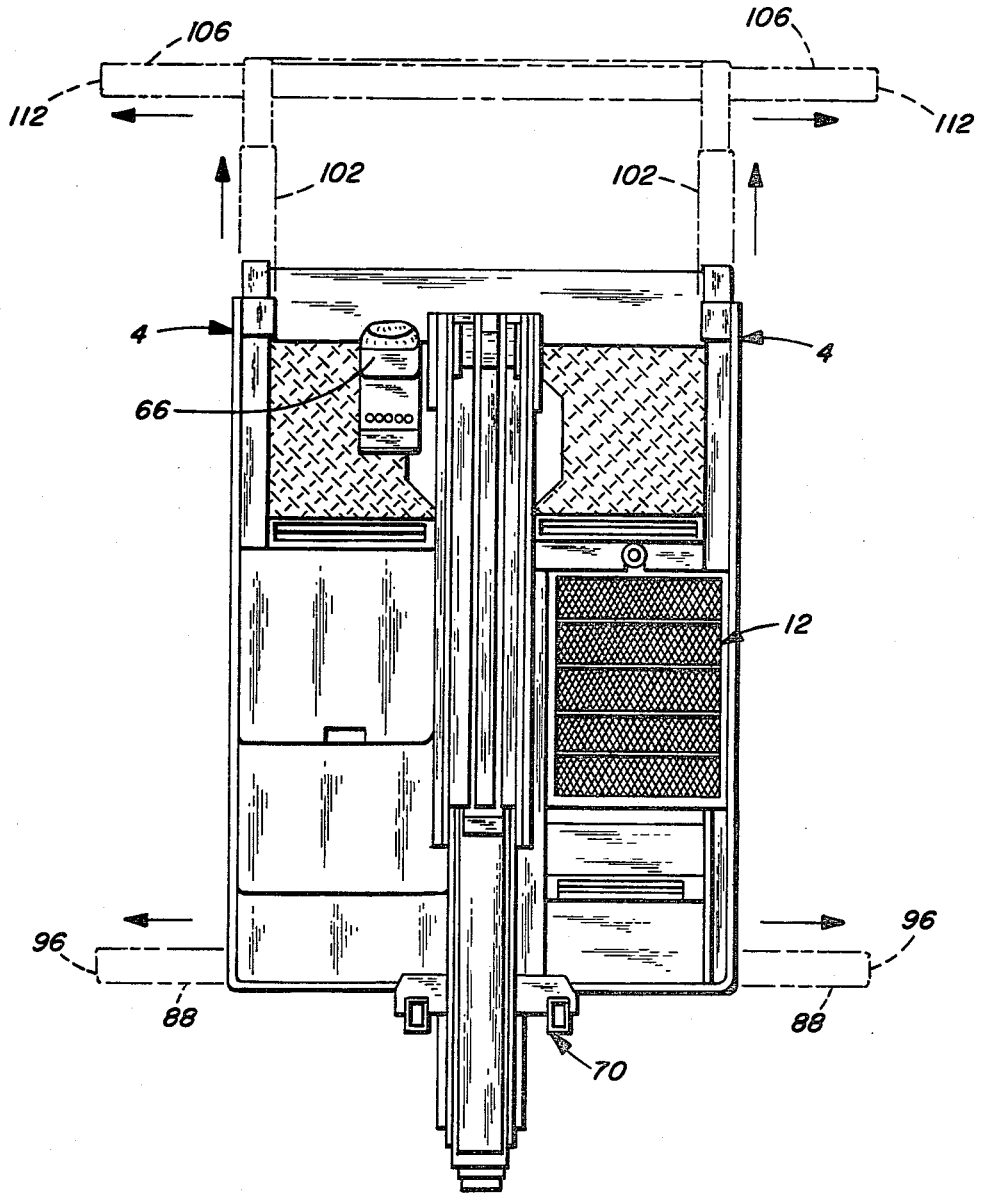
FIG. 11 is diagramatic top plan view illustrating the operation of the outrigger assembly.

As best illustrated in FIG. 6 the front outrigger mechanism 80 is attached to the vehicle chassis 4 by means of an outer polygonal tube 84 which extends across the with-wide dimension thereof. Within the tube 84 is disposed a pair of telescoping inner tube sections 86 and 88 adapted for independent width-wise transverse telescopic movement in respect to the longitudinal axis of the chassis 4. Telescopic movement of the inner tube sections 86 and 88 relative to one another within the outer tube section 86 is accomplished by means of a pair of hydraulic cylinders (one shown) 90 which are pivotally attached, as at 92, to the inner tubes, as at 94 and fixed to the outer tube 84. By this arrangement, upon actuation of the cylinders 90 the inner tubes 86 and 88, are moved outwardly away from one another (FIG. 11) on opposite sides of the vehicle chassis for extending the hydraulic jack mechanisms for supporting the vehicle above the supporting surface, such as a floor or the like.

In the embodiment shown, the hydraulic jack mechanisms each include an outer housing 96 attached to the ends of the inner-tube sections 86 and 88 which mounts an internal hydraulic cylinder 98 which actuates a jack support 100 for supporting the vehicle chassis at any predetermined horizontal and vertical position above the supporting surface, as illustrated in dotted line in FIG. 6. Accordingly, FIG. 6 illustrates one side of the front mechanism with the opposite side being identical thereto.

Figure 7:
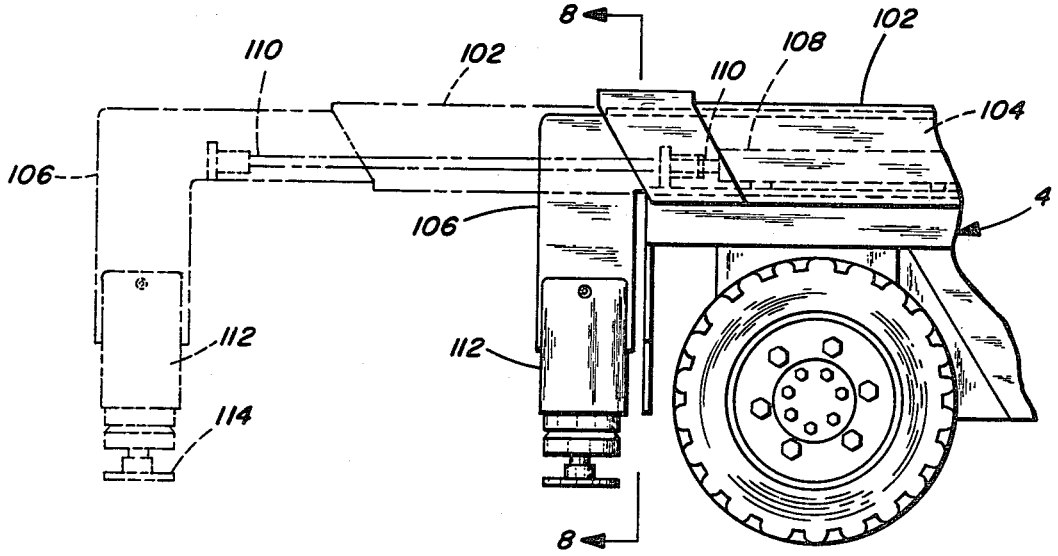
FIG. 7 is a fragmentary side elevation on an enlarged scale.
Figure 8:
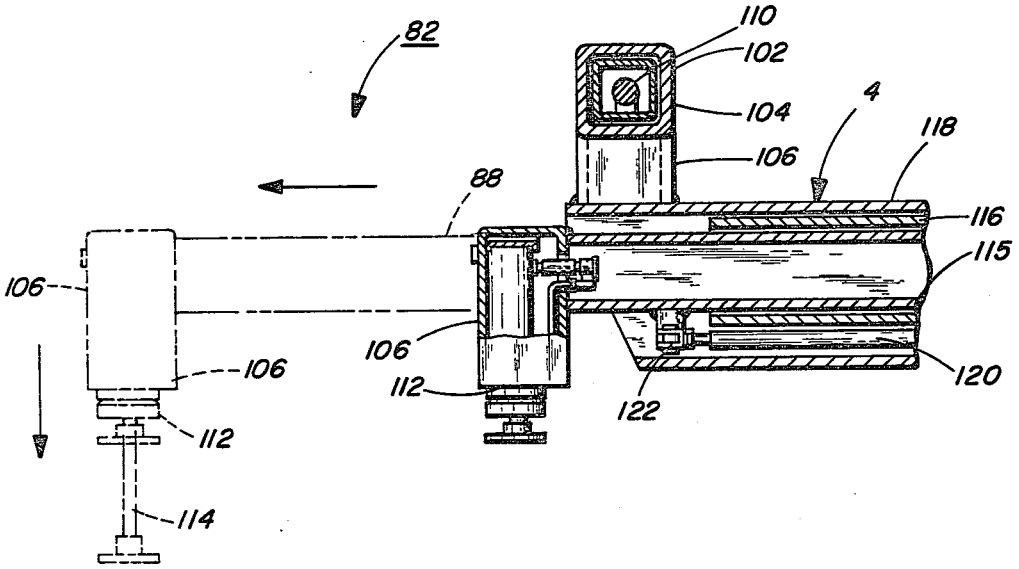
FIG. 8 is a fragmentary, vertical section view taken along the line 8—8 of FIG. 7.

As best illustrated in FIGS. 7 and 8, the rear outrigger mechanism 82 is also attached to the vehicle chassis 4 by means of a pair of longitudinally extending polygonal tubes 102 fixed to the chassis. The tubes 102 telescopically mount a pair of longitudinally extending, inner telescopic tube sections 104 which include integral downwardly extending arms sections 106 for telescopic inward and outward movement relative to the outer sections 102, as seen in dotted line in FIGS. 7 and 11. The inner sections 104 are mounted for longitudinal telescopic movement by means of a pair of hydraulic cylinders 108 having pistons 110 connected to the outer and inner tubes 102 and 104 for actuation of the arms 106 for longitudinally extending the arms as illustrated in the dotted line in FIGS. 7 and 11. The arms 106 mount a transversely extending outrigger mechanism which is identical to the front mechanism.

As in the case of the front outrigger mechanism, the rear mechanism 82 includes transversely extending inner telescopic tubes 115, which move within outer polygonal tube 116 fixedly connected to the arms 106. Here again, hydraulic jacks 112 with telescopic feet 114 are transversely extended by means of a pair of hydraulic cylinders 120 connected, as at 122, to the inner telescopic tubes 115 for transversely extending the jacks 112 in a lateral or transverse direction (FIG. 11) relative to the longitudinal axis of the vehicle chassis 4. Accordingly, the front outrigger mechanism may employ one pair of hydraulic cylinders, whereas, the rear outrigger mechanism may employ two pair of cylinders, as desired. The cylinders 90, 108 and 120 as well as the jacks 112 may all be indirectly and/or simultaneously operated from the operator's seat 18 to provide the desired support for the chassis. By this arrangement, there is provided a compound movement in that the outrigger mechanism 82 may extend longitudinally outwardly and then the hydraulic jack 112 extended transversely outwardly relative to the longitudinal axis of the vehicle chassis 4 to provide maximum stability for the vehicle during normal usage thereof.

While the form of the vehicle herein described constitutes a preferred embodiment of the invention, it is to be understood that the invention is not limited to this precise form of the vehicle and the changes may be made therein without departing from the scope of the invention.

I claim:

1. A Multi-Purpose Utility Vehicle comprising a vehicle chasis mounted for movement on a plurality of wheels, said chasis mounting adjacent the rearward end a telescopic boom assembly disposed for continuous rotation movement about a vertical axis through 360° a hydraulically actuated lift platform assembly disposed forwardly of such chasis, a pantograph-type outrigger assembly mounted at the rearward and forward ends of said chasis for supporting the vehicle during usage thereof said outrigger assembly including a rearward outrigger mechanism and a forward outrigger mechanism, said forward mechanism including a transverse outer tube section fixedly attached to said chasis, a pair of transversely extending inner tube sections disposed for telescopic sliding movement within said outer tube section, hydraulic motor means for transversely extending and contracting said inner tube sections in relation to said outer tube section, hydraulic jack means operably connected adjacent the outer ends of said inner tube sections adapted for vertical movement for raising and lowering said vehicle chasis, said rear outrigger mechanism including a pair of oppositely disposed longitudinally extending outer tube sections fixedly mounted on said vehicle chasis with telescopic intersections disposed interiorally of said outer sections for telescopic extension and contraction in a longitudinal direction, a transverse outer section fixedly connected to the outer ends of said longitudinal sections, transverse intersections mounted for telescopic movement within said transverse outer section, and hydraulic jack means being operably connected to the outer ends of said transverse intersections for vertical movement for raising and lowering said vehicle chasis.

2. A Multi-Purpose Utility Vehicle in accordance with claim 1, wherein said vehicle chasis includes a frame work mounted on said wheels, and said frame work mounting an operator station disposed laterally in off-set relation in respect to the longitudinal central axis of said vehicle chasis, said boom assembly including pivotally mounted telescopic boom sections mounted on a base member that is disposed rearwardly and centrally on the frame work such that said operators station is disposed in laterally off-set relation in respect to said base member.

3. A Multi-Purpose Utility Vehicle in accordance with claim 1, wherein said forward outrigger mechanism is disposed by said telescopic tube sections for a compound movement inwardly and outwardly in a lengthwise direction relative to said vehicle chasis and in a widthwise direction relative to said vehicle chasis, and said rear outrigger mechanism being disposed for widthwise outward and inward movement by said telescopic sections for stabilizing the vehicle upon actuation of said jack means.

4. A Multi-Purpose Utility Vehicle in accordance with claim 1, wherein said boom assembly includes an inner mast section mounted for pivotal movement in a vertical plane on a base member, said base member being pivotally mounted on said vehicle chasis for pivotal movement through 360°, and an outer mast section pivotally connected to said inner mast section with hydraulic cylinder means for pivoting said outer mast section in relation to said inner mast section.

5. A multi-purpose utility vehicle in accordance with claim 1, wherein said boom assembly includes a plurality of telescopic boom sections adapted for expansion and contraction upon actuation of hydraulic cylinder means, and control means mounted on the vehicle chassis for actuating said hydraulic cylinder means.

6. A multi-purpose utility vehicle in accordance with claim 1 wherein said lift-platform assembly includes a lift-platform member including a pair of oppositely disposed folk elements vertically driven by hydraulic cylinder means for raising the fork elements upwardly and downwardly, and hydraulic control means mounted on the vehicle chassis for operating said fork-lift member.

7. A multi-purpose utility vehicle in accordance with claim 1, including hydraulic control means mounted on said vehicle chassis for automatically controlling the extension and retraction of said inner telescopic sections in relation to said outer telescopic sections.

8. A multi-purpose utility vehicle in accordance with claim 1, wherein each of said jacks are individually hydraulically actuated by control means located on said vehicle chassis, and each of said outrigger mechanisms being individually actuated by hydraulic control means mounted on said vehicle chassis.

9. A Multi-Purpose Utility Vehicle comprises a vehicle chasis mounted for movement on a plurality of wheels, said chasis mounting adjacent one end a telescopic boom assembly adapted for continuous rotational movement about a vertical axis through 360°, a pantograph-type outrigger assembly mounted at the rearward and forward ends of said chasis for supporting and stabilizing said vehicle during usage thereof, said forward outrigger assembly including a first outer transverse polygonal tube mounted on said chasis and extending in a width-wise direction, a first pair of inner polygonal tubes disposed for independent telescopic movement within said outer transverse tube and transversely in respect to the longitudinal central axis of said vehicle, hydraulic jack means operably connected adjacent the outer ends of said inner tubes adapted for vertical movement for raising and lowering said chasis said rear outrigger assembly including a pair of laterally spaced, parallel polygonal tubes mounted on said chasis and extending in a length-wise direction relative to said chasis, an inner polygonal tube mounted for telescopic inward and outward movement within each of said outer tubes, hydraulic cylinder means for actuating said inner tubes, said inner tubes each having an integral downwardly extending arm section, said arm sections mounting a second transverse outer polygonal tube extending in a width-wise direction relative to said chasis, a second pair of inner polygonal tubes disposed for telescopic independent width-wise transverse movement within said second transverse outer tube, hydraulic cylinder means for actuating said second inner tubes, and hydraulic jack means operably connected the outer ends of said second inner tubes adapted for vertical movement for raising and lowering said vehicle chasis.

* * * * *